US005312531A

United States Patent [19]

Nishimura et al.

[11] Patent Number: 5,312,531

[45] Date of Patent: May 17, 1994

[54] PROCESS FOR MANUFACTURING GALVANIZED STEEL SHEET BY NICKEL PRE-COATING METHOD

[75] Inventors: Kazumi Nishimura; Hisao Odashima; Tetsuya Ohara; Ryohei Mizoguchi; Shigeto Fujii, all of Hyogo, Japan

[73] Assignee: Nippon Steel Corporation, Tokyo, Japan

[21] Appl. No.: 991,409

[22] Filed: Dec. 16, 1992

Related U.S. Application Data

[62] Division of Ser. No. 700,457, May 15, 1991, Pat. No. 5,203,985.

[30] Foreign Application Priority Data

Oct. 9, 1990 [JP] Japan ..... 2-271957

[51] Int. Cl.[5] ..... C25D 17/00; B05C 3/12

[52] U.S. Cl. ..... 204/206; 118/419; 118/620; 427/432; 427/434.2

[58] Field of Search ..... 204/206; 427/432, 433, 427/434.2; 118/620, 419

[56] References Cited

U.S. PATENT DOCUMENTS

| | | | |
|---|---|---|---|
| 3,620,805 | 11/1971 | Martin | 427/321 |
| 4,408,561 | 10/1983 | Yokoyama et al. | 427/433 |
| 4,436,292 | 3/1984 | Pfannschmidt | 427/321 |
| 4,478,892 | 10/1984 | Amberson | 427/432 |
| 4,738,758 | 4/1988 | Renaux et al. | 427/433 |
| 4,761,530 | 8/1988 | Scherer et al. | 427/543 |

FOREIGN PATENT DOCUMENTS

| | | | |
|---|---|---|---|
| 120771 | 1/1982 | Japan | 427/433 |
| 213650 | 10/1986 | Japan | 427/433 |
| 254145 | 10/1990 | Japan . | |
| 254145 | 10/1990 | Japan . | |
| 2082206 | 12/1981 | United Kingdom | 427/432 |

*Primary Examiner*—John Niebling
*Assistant Examiner*—Kishor Mayekar
*Attorney, Agent, or Firm*—Wenderoth, Lind & Ponack

[57] ABSTRACT

Process for manufacturing a galvanized steel sheet, comprising steps of coating a steel sheet with nickel in an amount of from 0.2 to 2 g/m$^2$, heating the steel sheet thus coated to a temperature within the range of from 420° C. to 500° C. in a non-oxidative atmosphere, and dipping the nickel coated steel sheet into a molten zinc bath containing aluminum at a content of from 0.1 to 1% without contact with air, wherein the steel sheet is dipped into the molten zinc bath within 15 seconds after the temperature of the steel sheet exceeds 350° C. in the heating step. An apparatus for performing the process comprises a nickel electroplating apparatus, a non-oxidative atmosphere-heating apparatus, and a galvanizing apparatus equipped with a molten zinc adhering amount-controlling device at the outlet side thereof, arranged sequentially in the steel sheet delivery direction, said non-oxidative atmosphere-heating apparatus comprising a ring transformer having a space for steel sheet delivery, a conductor roll provided at the inlet side of the ring transformer and being connected by use of an electroconductive member to a molten zinc bath of the galvanizing installation, thus a secondary coil of the transformer being formed from the conductor roll, the electroconductive member and the delivered steel sheet between the entering point in the molten zinc bath and the conductor roll contact point, and an atmospheric gas-feeding device for feeding a non-oxidative gas to the atmospheric chamber.

1 Claim, 5 Drawing Sheets

PROCESS FOR MANUFACTURING GALVANIZED STEEL SHEET BY NICKEL PRE-COATING METHOD

This is a divisional application of Ser. No. 07/700,457, filed on May 15, 1991 now U.S. Pat. No. 5,203,985.

BACKGROUND OF THE INVENTION:

1. Field of the Invention:

The present invention relates to a process for manufacturing a hot-dip galvanized steel sheet by a nickel pre-coating method.

2. Descrption of the Related Art:

Heretofore, the process for manufacturing a galvanized steel sheet by a nickel pre-coating method is already disclosed, for example, in Japanese Patent Publication Nos. 46-19282 and 63-48923.

In recent years, galvanized steel sheets, when used for building materials, household electric appliances, automobiles, and the like, are required to give superior surface appearance and superior coating adherence as important properties irrespective of their thickness, or whether they are made from hot-rolled sheets or cold-rolled sheets. The galvanized steel sheets manufactured by a nickel pre-coating method as disclosed in the aforementioned Japanese Patent Publication Nos. 46-19282 and 63-48923 give better external appearance and better coating adherence than those manufactured by other conventional galvanizing processes without nickel pre-coating such as a Sendzimir method or a non-oxidative furnace method. However, the nickel pre-coated galvanized steel sheets disclosed by the prior art, due to unsatisfactory heating conditions such as heating temperature and heating time after the nickel coating, are not optimal for securing surface appearance and coating adherence of building materials and household electric appliances, and coating adherence (or anti-powdering property) and corrosion resistance of severely worked portions for automobile application, especially when they are made from thick hot-rolled acid-pickled sheets. Therefore, further improvement of galvanized steel sheets is desired.

The inventors of the present invention studied the manufacturing process of the zinc-coated steel sheets by a galvanizing process employing a nickel pre-coating method to improve greatly the external appearance and the coating adherence, and further the coating adherence and the corrosion resistance of a severely worked portion thereof. Consequently, the inventors have found that the external appearance and the coating adherence, and further the coating adherence and the corrosion resistance of a severely worked portion are greatly improved, by conducting the galvanizing treatment under a specific heating condition after nickel pre-coating, in comparison with conventional galvanizing processes employing a nickel coating method.

As an experiment, a zinc-coating layer was prepared according to a conventional method of manufacturing a zinc-coated steel sheet employing a nickel pre-coating method as described in Japanese Patent Publication No. 46-19282, and the structure of the layer was investigated. In the preparation, after a steel sheet was pre-coated with 0.1 g/m$^2$ of nickel, the nickel pre-coated steel sheet was heated for 8 seconds at 200° C. which is the lowest heating temperature after nickel pre-coating as disclosed in the examples of the above-described patent publication. As the result, non-coating of zinc was caused and coating adherence was insufficient. Therefore, a more suitable heating temperature and a more suitable heating time were expected to be found for the heating treatment after the nickel pre-coating. In another experiment, a nickel pre-coated steel sheet was heated at 550° C. in a furnace as disclosed in Japanese Patent Publication No. 63-48923. As the result, some improvement was observed in comparison with the case of heating at 800° C. according to the Sendzimir method without nickel pre-coating. However, local non-coating of zinc is liable to occur, and the zinc coating adherence was insufficient and the surface appearance tended to become whitish. The cause is considered to be as follows. The heating temperature of 550° C. after the nickel pre-coating is still excessively high, and the heating time is excessively long because of furnace heating. Therefore, it is assumed that the nickel coating layer comes to diffuse into the base steel during the heating to form a Ni-Fe solid solution, becoming liable to be oxidized, which impairs coating adherence of zinc, and promotes formation of alloy of the base steel with zinc.

In view of the above investigation, the heating temperature range and the heating time after the nickel pre-coating are regarded as being important factors. Hence, investigation was made comprehensively regarding the heating conditions. Consequently, it was found that the surface appearance and the coating adherence of the zinc coating are greatly improved if nickel is coated in an amount of 0.2 to 2.0 g/m$^2$, and the steel sheet is heated, before entering into a zinc bath containing aluminum at a concentration of from 0.1 to 1.0%, to a temperature within the range of from the melting temperature of the bath to 500° C., and further the steel sheet is kept at a temperature of 350° C. or higher for a time of not longer than 15 seconds before reaching the entering temperature for dipping the steel sheet into the molten zinc bath. Further it was found that the coating adherence after severe working and the corrosion resistance of the worked portion are greatly improved if the heating rate after the nickel pre-coating is raised to 30° C./s or more. The resulting zinc coating layer was found to have a layer structure composed of a reaction layer, which consists of a quaternary alloy layer of Fe-Al-Zn-Ni, formed at the interface of the base steel, and a zinc coating layer formed thereon containing a minute amount of aluminum. Further, the Zn-Fe alloy layer on the base steel interface was found to be extremely thin.

As to the manufacturing process for realizing the manufacturing conditions such as rapid heating at a low cost with compact equipment, the beforementioned Japanese Patent Publication No. 46-19282 does not discloses specifically the constitution of the heating apparatus. On the other hand, the beforementioned Japanese Patent Publication No. 63-48923 discloses a heating method employing an indirect heating furnace. The indirect heating furnace, however, is based on radiation heating, employing a refractory-lined furnace body, which is not suitable for rapid heating and requires a long length of the furnace, resulting in a disadvantageous large-scale and expensive heating apparatus.

The inventors of the present invention investigated mainly the heating method, and have found a method for realizing an inexpensive and compact installation and conditions for producing a hot-dip galvanized steel sheet by employing direct resistance heating.

The present invention has been achieved based on the above-described findings.

SUMMARY OF THE INVENTION

The present invention intends to provide a process for manufacturing a galvanized steel sheet having superior surface appearance and coating adherence, and further giving coating adherence and corrosion resistance of a severely worked portion thereof.

The present invention further intends to provide a continuous process for manufacturing a hot-dip galvanized steel sheet which is practicable with a compact apparatus at low cost.

The present invention provides a process for manufacturing a galvanized steel sheet, comprising steps of coating a steel sheet with nickel in an amount of from 0.2 to 2 g/m$^2$, heating the steel sheet thus coated to a temperature within the range of from 420° C. to 500° C. in a non-oxidative atmosphere, and dipping the nickel coated steel sheet into a molten zinc bath containing aluminum at a content of from 0.1 to 1% without contact with air, wherein the nickel coated steel sheet is dipped into the molten zinc bath within 15 seconds after the temperature of the steel sheet exceeds 350° C. in the heating step.

The present invention also provides a process for manufacturing a galvanized steel sheet, comprising steps of coating a steel sheet with nickel in an amount of from 0.2 to 2 g/m$^2$, rapidly heating the steel sheet at a heating rate of not less than 30° C./s to a temperature within the range of from 430° C. to 500° C. in a non-oxidative atmosphere, and dipping the steel sheet into a molten zinc bath containing aluminum at a content of from 0.1 to 1% without contact with air.

The present invention further provides a continuous hot-dip galvanization installation for galvanization of a nickel pre-coated steel sheet: comprising a nickel electroplating apparatus, a non-oxidative atmosphere-heating apparatus, and a galvanizing apparatus equipped with a molten zinc adhering amount-controlling device at the outlet side thereof, arranged sequentially in the steel sheet delivery direction; said non-oxidative atmosphere-heating apparatus comprising a ring transformer having a space for steel sheet delivery, a conductor roll provided at the inlet side of the ring transformer and being connected by use of an electroconductive member to a molten zinc bath of the galvanizing installation, thus a secondary coil of the transformer being formed from the conductor roll, the electroconductive member and the delivered steel sheet between the entering point in the molten zinc bath and the conductor roll contact point, where the resistance $R_1$ of the steel sheet and the resistance $R_2$ of the electroconductive member is in the relation of $R_1 > R_2$; an atmospheric chamber enclosing the steel sheet within the range from the inlet side or the backside of the conductor roll to the point just below the surface of the molten zinc bath; and an atmospheric gas-feeding device for feeding a non-oxidative gas to the atmospheric chamber.

DETAILED DESCRIPTION OF THE PREFERRED EMBODIMENT

The term "non-oxidative atmosphere" in the present invention includes a non-oxidizing atmosphere (e.g., $H_2$ 0.1–3%+$N_2$, $O_2$: several ten ppm) and a reducing atmosphere (e.g., $H_2$ 15%+$N_2$ atmosphere).

The present invention is described below in detail by reference to the figures.

Figure 1:
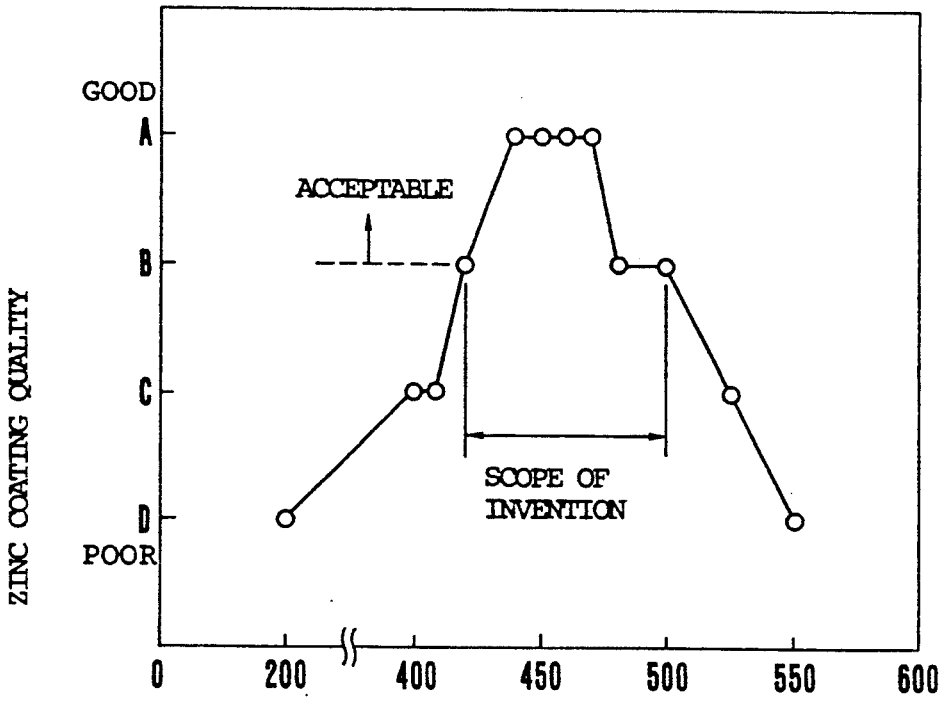
FIG. 1 illustrates the dependence of the zinc coating quality on the heating temperature of the steel sheet after nickel pre-coating.

FIG. 1 illustrates dependence of the zinc coating quality on the heating temperature of the steel sheet after nickel pre-coating.

On a hot-rolled aluminum-killed steel sheet (thickness: 3.2 mm), a pre-coated nickel layer was formed in an amount of 0.5 g/m$^2$ by electroplating. Then the pre-coated sheet was heated by direct resistance heating in a nitrogen atmosphere containing 60 ppm oxygen and 3% hydrogen to a temperature within the range of from 200° C. to 550° C., and immediately coated in a galvanizing bath containing 0.2% aluminum for 3 seconds. The time of heating the sheet from 350° C. to a bath-entering temperature was fixed at 10 seconds. The coating amount was 135 g/m$^2$. The coating quality was evaluated in consideration of a combination of the external appearance of the coating (or degree of non-coating) and the coating adherence (or ball impact test: B.I.).

The criteria of the evaluation are as below.

| Evaluation of Coating quality | | |
|---|---|---|
| Rank | Coating appearance Non-coating | Coating adherence B.I. grading |
| A | none (highly glossy) | 1 (best) |
| B | none (less glossy) | 2 |
| C | partly non-coating | 3–4 |
| D | non-coating | 5 |
| | (Ranks A and B are acceptable) | |

As shown in FIG. 1, the coating appearance and the coating adherence were excellent in the case where the temperature of the heated sheet before the galvanization was in the range of from 420° C. to 500° C., which is the temperature range specified in the present invention. At a temperature below 420° C., the coating appearance and the coating adherence tended to deteriorate. At the temperature of 200° C. which is described in an Example of Japanese Patent Publication No. 46-19282, non-coating was highly liable to occur. On the contrary, at the temperature of the heated sheet of above 500° C., the coating adherence and the corrosion-resistance deteriorated. At the temperature of 550° C. which is described in an Example of Japanese Patent Publication No. 63-48923, neither satisfactory coating appearance nor satisfactory coating adherence could be attained.

Figure 2:
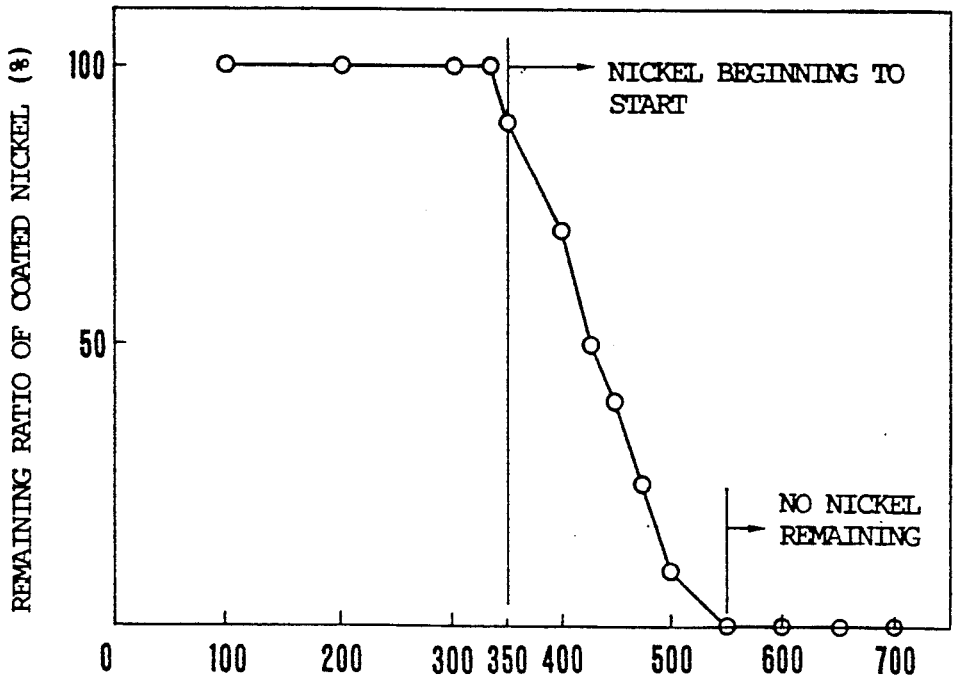
FIG. 2 illustrates the dependence of the amount of diffusion of pre-coated nickel layer into the base steel on the heating temperature.

FIG. 2 illustrates the dependence of the amount of diffusion of the pre-coated nickel layer into the base steel on the heating temperature.

On a hot-rolled aluminum-killed steel sheet (thickness: 3.2 mm), a nickel pre-coating layer was formed by electroplating in an amount of 0.2 g/m$^2$. The sheet pre-coated with nickel was heated for 5 seconds by direct resistance heating in a nitrogen atmosphere containing 60 ppm oxygen and 3% hydrogen. Then the remaining ratio of the nickel coating layer was measured by the depth-direction analysis of Auger (AES). At the heating temperature of approximately 350° C., the pre-coated nickel layer obviously begins to diffuse into the base steel. At a temperature exceeding 500° C., the nickel layer disappears almost entirely.

Figure 3:
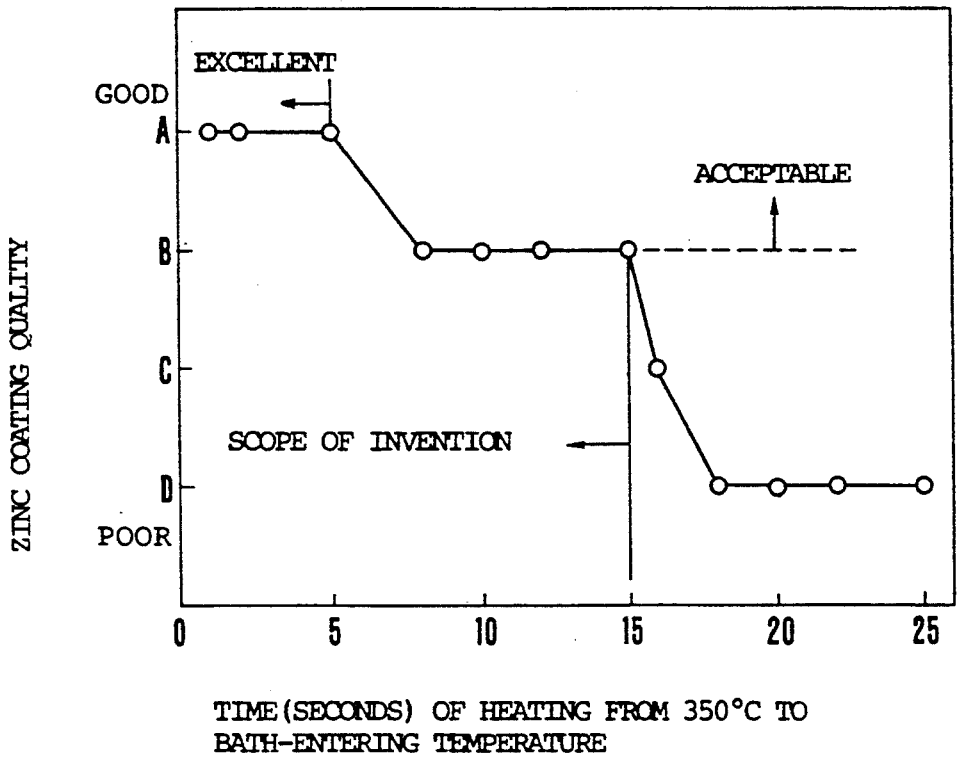
FIG. 3 illustrates the dependence of the zinc coating quality on the time for heating the steel sheet from 350° C. to the bath-entering temperature.

FIG. 3 illustrates the dependence of the coating quality on the time elapsed in heating the sheet from 350° C. to the bath-entering temperature. At the temperature exceeding 350° C., nickel begins to diffuse. On a hot-rolled aluminum-killed steel sheet (thickness: 3.2 mm), a pre-coated nickel layer was formed in a coating amount of 0.5 g/m$^2$ by electroplating. The sheet pre-coated with nickel was heated by direct resistance heating in a nitrogen atmosphere containing 60 ppm oxygen and 3% hydrogen. When heated up to the bath-entering temperature of 450° C., the sheet was immediately dipped in a zinc coating bath kept at 450° C. and containing 0.2% aluminum and was galvanized for 3 seconds. The amount of coating was adjusted to 135 g/m$^2$. The coating quality is obviously satisfactory in the cases where the time for heating the pre-coated sheet from 350° C. to the bath-entering temperature is not longer than 15 seconds.

When the average heating rate (or temperature rising rate) from the start of heating to the bath-entering temperature is 30° C./s or higher, the time for heating from 350° C. to the bath-entering temperature is 5 seconds or shorter, and the coating quality is obviously excellent as shown in FIG. 3. The galvanized steel sheet thus prepared was further investigated as to the coating adherence and the corrosion resistance of the severely worked portion.

Figure 4:
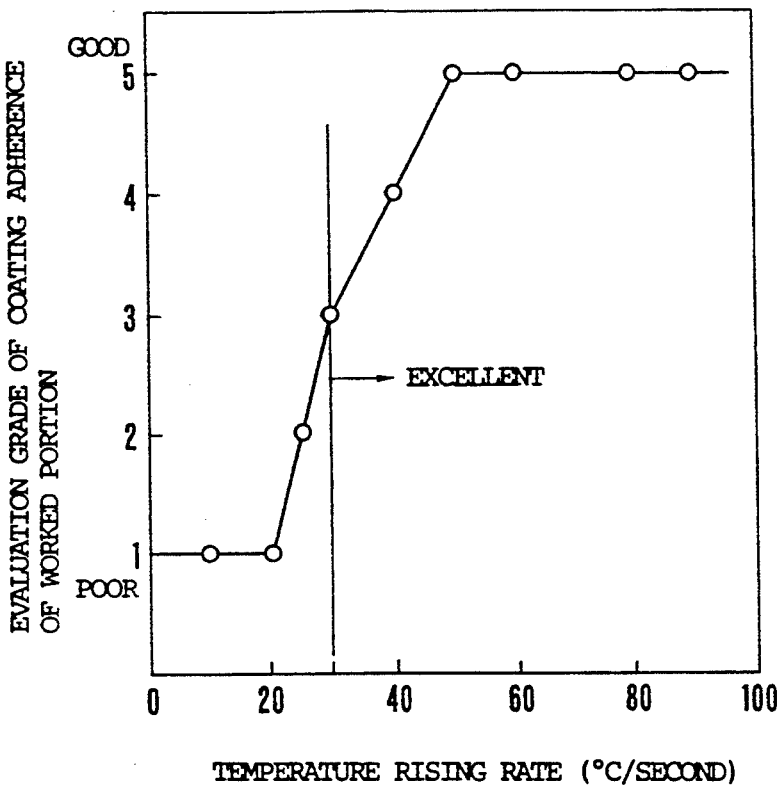
FIG. 4 illustrates the dependence of zinc coating adherence of a worked portion on the temperature rising rate on heating.
Figure 5:
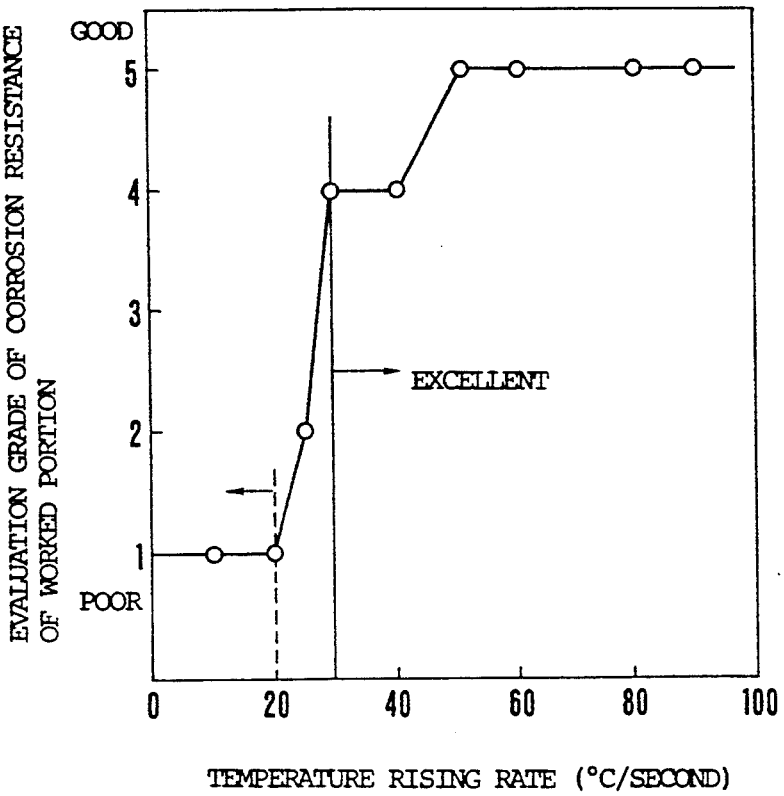
FIG. 5 illustrates the dependence of corrosion resistance of a worked portion on the temperature rising rate on heating.

FIG. 4 and FIG. 5 show respectively the dependence of coating adherence and the dependence of corrosion resistance of the worked portion on the temperature rising rate after the nickel pre-coating treatment. A hot-rolled aluminum-killed steel sheet (1.6 mm thick) was pre-coated with nickel by electroplating in an amount of 0.5 g/m$^2$, and heated at various rates of temperature rising up to 450° C. by direct resistance heating in a nitrogen atmosphere containing 60 ppm oxygen and 3% hydrogen, and thereafter the heated steel sheet was subjected to coating in a hot-dip galvanizing bath containing 0.2% aluminum for 3 seconds. The coating amount was adjusted to 135 g/m$^2$. To reproduce a severely worked portion, the galvanized steel sheet was subjected to deep drawing to give a cup having a 25 mm overhang. The coating quality was evaluated according to a tape peeling test for powdering resistance, the evaluation being made by the degree of blackening of the tape. The corrosion resistance after working was evaluated in such a manner that a test specimen of the cup formed by drawing was subjected to a corrosion cycle test (CCT) for one week and the rust development ratio at the worked portion was observed. The coating adherence at the worked portion and the corrosion resistance at the worked portion were rated respectively on five grades. The grades of 3 and higher are particularly satisfactory in both the coating adherence and corrosion resistance at severe working. The criteria of the evaluation are as below.

| Grade | Coating adherence Tape blackening ratio | Corrosion resistance at worked portion Rust occurrence ratio |
|---|---|---|
| 5 | Below 1% | Below 5% |
| 4 | 1% or more, below 5% | 5% or more, below 10% |
| 3 | 5% of more, below 10% | 10% or more, below 20% |
| 2 | 10% or more, below 20% | 20% or more, below 30% |
| 1 | 20% or more | 30% or more |

Obviously, the coating adherence and the corrosion resistance at the severely worked portion are particularly satisfactory in the cases where the temperature rising rate after the nickel pre-coating is not less than 30° C./s.

The preferable temperature of the heated steel sheet was in the range of from 430° C. to 500° C. in view of the coating adherence of a severely worked portion.

In the present invention, the important point for manufacturing galvanized steel sheets having a superior coating quality is that the heating temperature after the pre-coating is within a specific range and the time of heating from 350° C. to the bath-entering temperature is not longer than 15 seconds. One more important point for manufacturing a galvanized steel sheet with superior high coating adherence and superior corrosion resistance at a severely worked portion is that the steel sheet after nickel pre-coating is heated at a heating rate of not less than 30° C./s.

The nickel is pre-coated in an amount of not less than 0.2 g/m$^2$, because non-coating of zinc can be avoided thereby and the coating adherence is improved by formation of Fe-Al-Zn-Ni quaternary alloy layer to inhibit undesired development of an Fe-Zn alloy layer. With the nickel coating in an amount of less than 0.2 g/m$^2$, non-coating of zinc is liable to occur and coating adherence is liable to deteriorate. Further, the nickel pre-coating amount is limited to not more than 2.0 g/m$^2$ because the coating adherence becomes inferior at the coating amount exceeding 2.0 g/m$^2$. In this case, it is assumed that a Ni-Al-Zn type alloy layer develops more at the interface of the base steel, retarding the formation of the barrier layer for preventing the alloying of zinc with base steel, namely an Fe-Al-Zn-Ni type quaternary alloy layer, thus promoting alloying of zinc with base steel.

An aluminum content of less than 0.1% in the bath causes unsatisfactory coating adherence. In this case, it was found that an alloy layer of Fe-Al-Zn-Ni type is formed only in a little amount, a Zn-Fe alloy layer grows thicker at the interface of the base steel, and in particular a Γ phase ($Fe_5Zn_{21}$) allowing a brittle interface to develop, which causes cracks in working, resulting in exfoliation of the coating from the Γ phase.

The aluminum content in the bath is limited to 1% or less. This is because at a higher content thereof the surface appearance becomes whitish, and if aluminum distributes non-uniformly in the galvanized layer, it forms a local electric cell in the galvanized layer to cause elution of zinc to deteriorate the corrosion resistance.

The amount of the zinc coating is preferably not less than 10 g/m$^2$ in view of corrosion resistance, and is not more than 350 g/m$^2$ in view of workability, although the amount is not particularly limited thereto.

In the above description, the molten zinc galvanizing bath containing aluminum only as a minor component was discussed. Similar results were obtained with galvanized steel sheets prepared with a bath which contains nickel, antimony, or lead as an alloy element singly or combinedly in addition to aluminum in a minor amount of not more than 0.2%.

The bath temperature is as usual in the range of from 430° C. to 500° C. whether using the zinc bath or a zinc bath containing a minor amount of an additional alloy element.

The base steel sheet includes hot-rolled steel sheets, cold-rolled steel sheets, or other various steel sheets such as aluminum-killed steel sheets, Al-Si-killed steel sheets, Ti-Sulc, P-TiSulc low carbon steel sheets, high tensile steel sheets, and the like.

The manufacturing installation should satisfy the requirements of the process according to the present invention, and the installation according to the present invention is preferably of such a structure that the heating rate can readily and rapidly be set and the installation can be made compact for a wide range of sheets from thin sheets to thick sheets of 3 mm thickness or more.

The manufacturing installation according to the present invention is described in detail by reference to the drawings.

Figure 7:
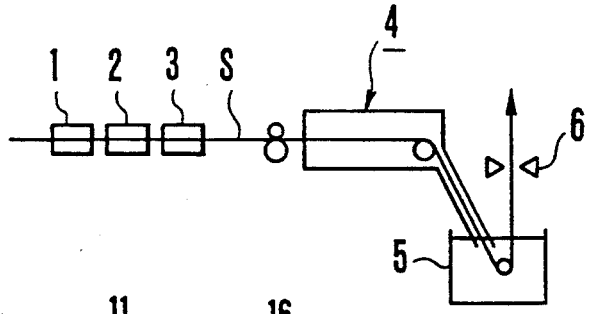
FIG. 7 illustrates an outline of an installation of the present invention.

FIG. 7 illustrates the outline of the installation of the present invention. A nickel electroplating apparatus 1, a rinsing apparatus 2, a drying apparatus 3, a non-oxidative atmosphere-heating apparatus 4, and a galvanizing apparatus 5 equipped with a molten zinc coating amount-adjusting device 6 at the outlet side are arranged sequentially in the delivery direction of the steel sheet. A steel sheet S having a cleaned surface is coated with nickel by the nickel electroplating apparatus 1 by heating at a low temperature in a coating amount of from 0.2 to 2.0 g/m$^2$ to strengthen the adherence between the steel sheet S and the molten zinc, washed with water by the rinsing apparatus 2, dried by the drying apparatus 3, heated to a predetermined bath-entering temperature by the non-oxidative atmosphere-heating apparatus 4 by preventing oxidation of the nickel-coated steel sheet, and then passed through the molten zinc bath of the galvanizing apparatus 5, to be galvanized without contact with the air.

Figure 8:
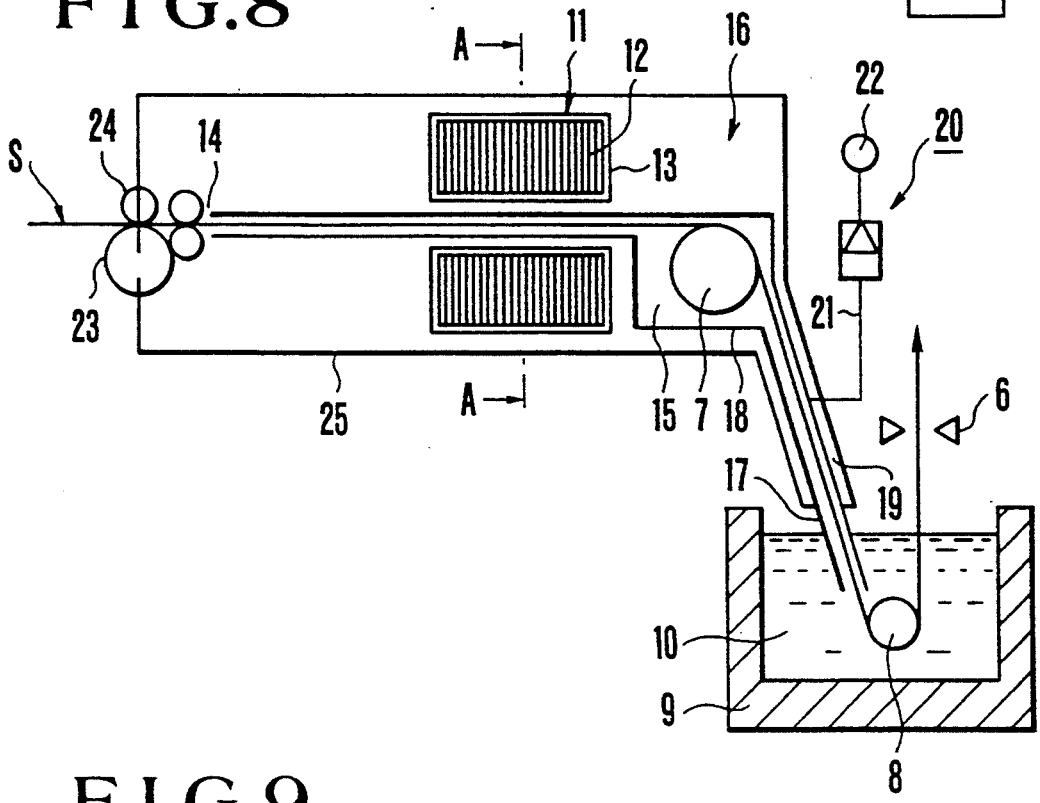
FIG. 8 is a detailed illustration of an atmosphere-heating device.
Figure 9:
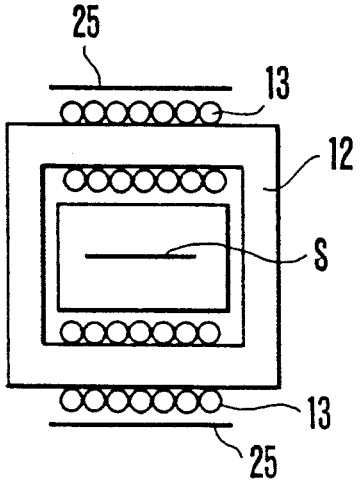
FIG. 9 is a cross-sectional view at the line A—A in FIG. 8.

FIG. 8 is a detailed illustration of a non-oxidative atmosphere-heating device. FIG. 9 is a cross-sectional view at the line A—A in FIG. 8.

In FIG. 8 and FIG. 9, a turn-down roll 7 and a sink roll 8 in a molten zinc bath 10 in a galvanizing pot 9 constitute a pass line of the steel sheet S. The steel sheet S is delivered horizontally to the turn-down roll 7 and therefrom delivered obliquely to the sink roll 8, and then delivered upward.

A ring transformer 11 is arranged at the inlet side of the turn-down roll 7 so as to allow the delivery of the steel sheet S through the space of the ring-transformer. The ring-transformer 11 has an iron core 12 and a primary coil 13. Both ends of the primary coil are connected to an alternating current power source not shown in the drawing.

Seal rolls 14 are equipped at the inlet of the ring-transformer 11. An atmospheric chamber 15 is provided to enclose the delivered steel sheet S from immediately after the seal rolls 14 to immediately below the surface of the molten zinc bath 10, and the turn-down roll 7. The portion 17, just above and just below the bath surface, of the enclosure 16 constituting the atmosphere chamber 15 is formed from an electroconductive body such as stainless steel, and the other portion 18 of the enclosure is formed from a non-magnetic body such as stainless steel. The electroconductive enclosure 17 and the non-magnetic enclosure 18 are linked together by means of an electric insulating material 19 such as asbestos.

An atmospheric gas-supplying device 20, which is constituted of a supplying tube 21 connected to the non-magnetic enclosure 18, and a gas source 22 connected to the supplying tube 21, supplies a non-oxidative gas to the atmosphere chamber 15. The atmospheric gas supplied by the atmospheric gas-supplying device 20 fills the atmospheric chamber 15 and flows out from the opposing gap between the seal rolls 14 and the non-magnetic enclosure 18.

A conductor roll 23 is provided at the inlet side of the seal rolls 14. A back-up roll 24, which is lined with rubber or the like, is provided to attain plain contact of the conductor roll 23 to the steel sheet S.

A busbar 25 connects the conductor roll 23 and the electroconductive enclosure 17. A secondary coil of the aforementioned ring-transformer 11 is formed from the electroconductive member constituted of the busbar 25 and the electroconductive enclosure 17, the steel sheet S delivered between the entering position to the molten zinc bath and the contact position with the conductor roll, and the molten zinc bath 10.

Figure 10:
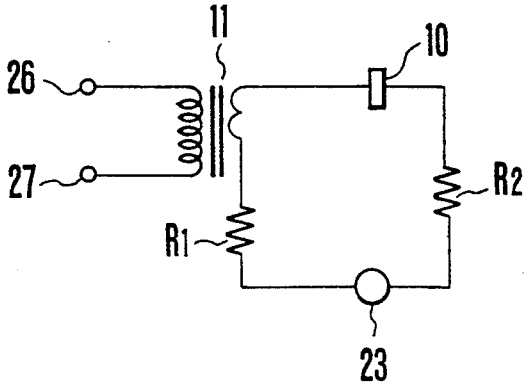
FIG. 10 is an electric circuit diagram of the atmosphere-heating apparatus.

FIG. 10 is an electric circuit diagram of the above heating apparatus. The primary side of a transformer 11 is connected through terminals 26 and 27 to an alternating current power source not shown in the drawing. A closed secondary circuit of the transformer 11 is formed from the conductor roll 23, the molten zinc bath 10, the resistance $R_1$ representing the steel sheet S between the conductor contact point and the molten zinc bath-entering point, and the resistance $R_2$ representing the electroconductive member constituted of the busbar 25 and the electroconductive enclosure 17. $R_1$ on the closed secondary circuit represents the equivalent resistance of the steel sheet S, and $R_2$ represents the equivalent resistance of the electroconductive member constituted of the busbar 25 and the electroconductive enclosure 17. The steel sheet S has relatively high electrical resistance, and the electroconductive member constituted of the busbar 25 and the electroconductive enclosure 17 can be set so as to have any desired dimensions of such as a cross-sectional area. Accordingly, the relation of the resistance $R_1$ of the steel sheet S can readily be made much larger than the resistance $R_2$ constituted of the busbar 25 and the electroconductive enclosure 17. Since the closed circuit contains the electroconductive member of low resistance constituted of the busbar 25 and the electroconductive enclosure 17 as the return wire, the steel sheet S having much higher electric resistance than the electroconductive member can be heated in high efficiency by the current flowing therein.

The transformer 11 is placed between the conductor roll 23 and the molten zinc bath 10, and the steel sheet S of sufficiently high resistance is placed in the secondary side of the transformer. Therefore almost all of the applied voltage is utilized as a load current to heat the steel sheet S between the conductor roll 23 and the molten zinc bath 10, so that the no-load current is negligible and little leakage is caused. The external voltage (U') is represented by the formula:

$$U' = [(R_2)/(R_1+R_2)] \times U$$

where U is no-load current. The above-mentioned effect is brought about since $R_1 > R_2$.

In passing electric current through the steel sheet to heat it by use of a conductor roll, passage of a larger quantity of current produces spark between the conductor roll and the steel sheet, causing a spark flaw on the steel sheet. The spark flaw on a nickel-coated steel sheet will become a non-coated portion after galvanization.

Generally, the higher the temperature of the steel sheet, the smaller is the current which can be passed without producing spark (namely, an allowable current). Therefore, if the current is passed by use of a conductor roll at the high temperature side of the steel sheet, the current cannot exceed the allowable curent for the high-temperature conductor roll, which is weaker than the allowable current for the conductor roll employed at the low temperature side of the steel sheet. However, in the present invention, the current passage to the steel sheet at the high temperature side is conducted by molten zinc which causes no spark, so that the current can be increased to the allowable maximum current of the conductor roll of the low temperature side, which advantageously enables an increase of the heating rate.

For example, the allowable current density (total current/strip width) is 100 A/mm at a steel sheet temperature of 50° C., and 15 A/mm at 500° C. Therefore, in the abovementioned heating apparatus, in which the current passage to the high-temperature steel sheet is conducted by molten zinc, the heating zone length for heating the steel sheet S of 6.0 mm×950 mm from 50° C. to 500° C. at a rate of 40 mpm (the length of the steel sheet between the conductor roll 23 and the molten zinc bath 10) can be as short as 16 m.

On the other hand, with a conventional indirect heating furnace, the necessary heating length for heating the steel sheet S under the same conditions as above is as long as 90 m at the furnace temperature of 1000° C. Moreover, the furnace body is required to be lined with refractory material in order to maintain the furnace temperature at 1000° C. On the contrary, in the heating apparatus of the present invention, the steel sheet is heated by the current passing therein, so that the enclosure constituting the atmosphere-heating chamber for heating the steel sheet need not be lined with the aforementioned refractory material to maintain the high temperature of the furnace.

As described above, the atmosphere-heating apparatus of the present invention is capable of heating a steel sheet to the molten zinc bath-entering temperature at high efficiency with safety at a temperature rising rate much higher than a conventional indirect heating furnace, so that the heating length is greatly decreased compared to that of the indirect heating furnace. Further, in the apparatus of the present invention, which is of a direct resistance heating system, the enclosure constituting the atmosphere-heating chamber does not require refractory lining which is indispensable for a conventional indirect heating furnace, and the apparatus can be inexpensive because of the short heating zone length and needlessness of the refractory lining resistant to high temperature.

The seal rolls 14 may be placed either in the inlet side of the conductor roll 23 or immediately behind the conductor roll 23 so as to form the atmosphere chamber 15 to cover the space from the inlet side of or immediately behind the conductor roll 23 to the molten zinc bath. Otherwise, the conductor roll 23 and the back-up roll 24 are utilized to serve as the seal rolls 14, thereby the seal rolls 14 being omitted.

In the above-description, a part of the enclosure 16 and electroconductive enclosure 17 is utilized as a part of the electroconductive member for connecting the conductor roll 23 with the molten zinc bath 10. Alternatively, the electroconductive member is formed only from the busbar 25 such that the end of the busbar 25 other than the end connected to the conductor roll 23 is connected directly to the molten zinc bath 10.

Figure 6:
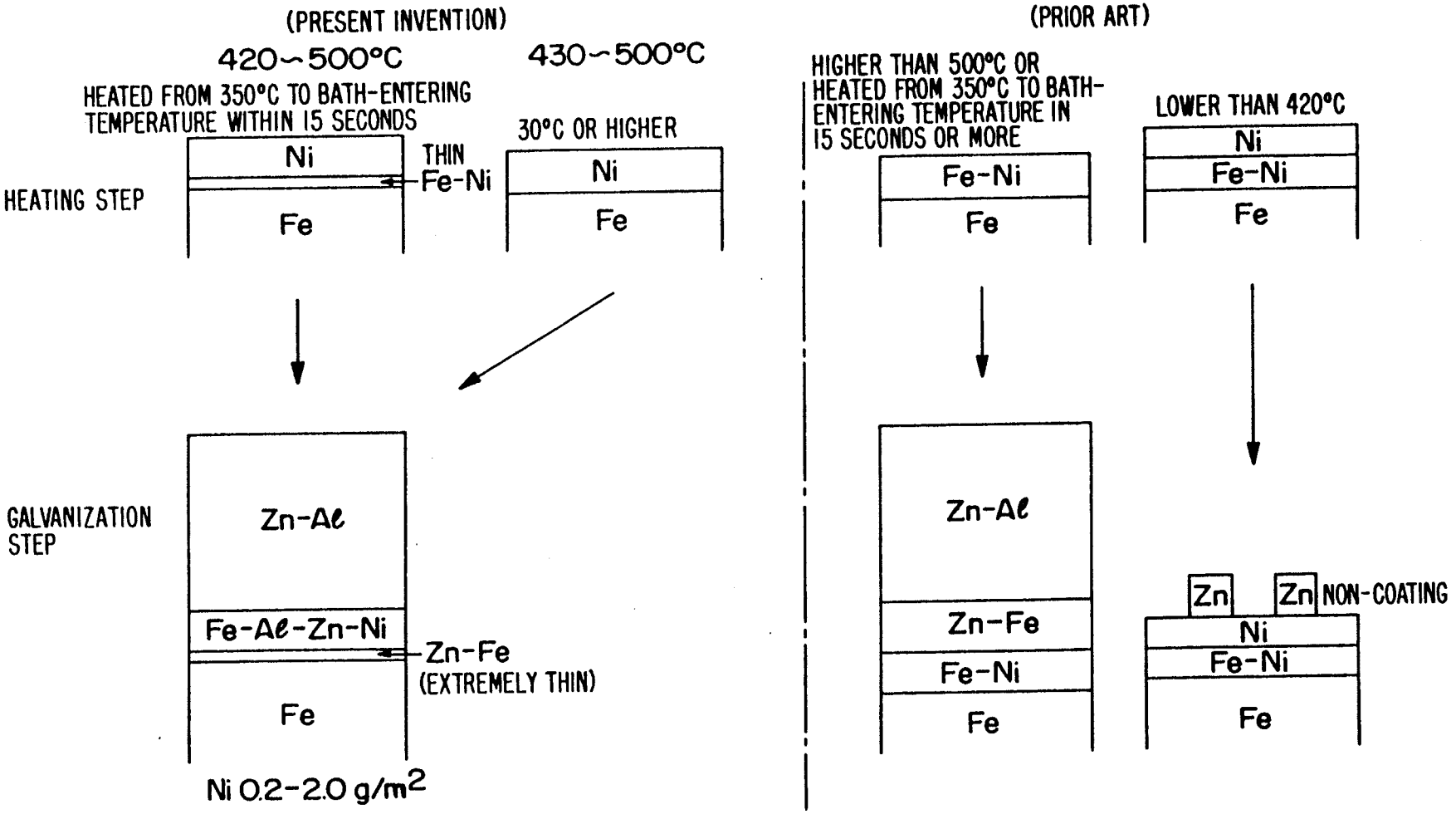
FIG. 6 illustrates schematically the constitution of the galvanized zinc layer formed by the manufacturing process of the present invention, and the state of the pre-coated nickel layer at the pre-heating step, in comparison with that of a conventional manufacturing process.

FIG. 6 illustrates schematically the results of analysis of the constitution of the coated layers prepared according to the present invention and a conventional nickel pre-coating method. Under the conditions of heating subsequent to the nickel pre-coating of the present invention, the sheet is heated to a temperature in the range of from 420° C. to 500° C. and the time for the heating the sheet from 350° C. to the bath-entering temperature is not longer than 15 seconds. Under such conditions, the pre-coated nickel layer diffuses less into the base steel and is mostly kept remaining on the surface of the base steel. Further, at the temperature rising rate of 30° C./s or higher after the nickel coating, the nickel almost entirely remains in a coated state, and little diffusion into the base steel is observed. On the contrary, when the temperature is higher (exceeding 500° C.) as in prior art, or the time for heating from 350° C. to the bath-entering temperature is excessively long, the nickel diffuses almost completely into the base steel to form an iron-nickel solid solution layer. Furthermore, when the heating temperature is lower than 420° C. as in the prior art, even though the nickel remains in the coated state, non-coating of zinc is liable to occur during the galvanization treatment, and the coating adherence is unsatisfactory.

This difference of the states of the nickel at the heating is considered to give rise to the difference of the galvanized layer constitution in the later galvanization treatment. Specifically, with the amount of the nickel coating of from 0.2 to 2.0 g/m$^2$, the pre-coated nickel layer remaining largely on the interface of the base steel will form an Fe-Al-Zn-Ni quaternary alloy layer (a barrier layer) around the interface of the base steel, and the Zn-Fe alloy layer is kept thin without growth thereof. An aluminum-containing zinc layer is formed further thereon. On the contrary, in conventional processes, the pre-coated nickel layer almost disappears in the heating step, so that a thick Zn-Fe layer is formed on the Fe-Ni layer formed by the heating, and a zinc layer containing aluminum is formed further thereon during the galvanization, without formation of an Fe-Al-Zn-Ni type alloy layer as in the present invention.

Although the details are not clearly known, the great improvement of the coating adherence in the present invention is assumed to be due to the fact that the quaternary alloy layer at the interface of the base steel serves as a binder and further exhibits a barrier effect of inhibiting the growth of the Zn-Fe alloy layer.

EXAMPLES

Table 1 shows the examples of the manufacturing conditions of galvanized steel sheet, and the evaluation results thereof. The mark * denotes the comparative material prepared by a method other than the method of the present invention. Hot-rolled and acid-pickled steel sheets SGHC (3.2 mm thick and 1.6 mm thick) were employed as the substrate sheet. These substrates were pre-coated with nickel according to electroplating in a sulfuric acidic nickel bath. The pre-treatment heating was conducted by direct resistance heating in a nitrogen atmosphere containing 60 ppm oxygen and 3% hydrogen under various heating conditions. The galvanization was conducted at 450° C. for 3 seconds in the galvanizing bath in which the aluminum content was varied. The amount of coating was adjusted to 135 g/m$^2$ by nitrogen wiping. The coating quality was evaluated based on the criteria mentioned above.

The galvanized steel sheets prepared under the conditions of the present invention, namely the nickel pre-coating of 0.2–2.0 g/m$^2$, the temperature of the heated sheet of 420° to 500° C., and the time of heating from 350° C. to a galvanizing-bath-entering temperature of not more than 15 seconds, do not cause non-coating of zinc, and are satisfactory in coating adherence, having clearly excellent coating quality, as shown by the samples of No. 1 to No. 20.

As shown by the samples of No. 32 to No. 42, it is also obvious that not only the coating appearance and the coating adherence of the galvanized sheet, but also the coating adherence and the corrosion resistance of the severely worked portion thereof, are satisfactory in the cases where the steel sheet is pre-coated with nickel in a coating amount of 0.2–2.0 g/m$^2$ and is heated to a temperature in the range of 430° C. to 500° C., and the temperature rising rate is 30° C./s or higher.

On the contrary, the comparative samples which were prepared under the conditions where the amount of nickel pre-coating, the heating conditions, and the aluminum content in the bath are outside the scope of the present invention (Nos. 21–28) were inferior in the coating quality, including the case of no nickel pre-coating (No. 21).

Additionally, the samples of Nos. 29–31, which were prepared in a galvanizing bath containing an additional alloying element, also had satisfactory properties.

The manufacturing installation could be made compact by practicing the method as shown in FIG. 7 and FIG. 8, whereby the construction cost of the installation could greatly be reduced in comparison with the conventional method.

As described above, the present invention provides a process for producing a galvanized steel sheet which has an excellent coating quality, or gives coating adherence and corrosion resistance of a worked portion of a zinc coated steel sheet, which has never been met hitherto. The galvanized steel sheets are useful as structural materials such as building materials, household electrical appliances, and automobiles, and are producible with a compact installation at a low cost, so that the present invention is highly important industrially.

TABLE 1-1

(Mark * denotes comparative material)

| Sample No. | Amount of pre-coated nickel (g/m$^2$) | Heating conditions: Temperature of heated sheet (°C.) | Heating conditions: Time at 350° C. or higher (s) | Galvanization bath composition: Aluminum % by weight | Galvanization bath composition: Additional alloy element % by weight | Zinc coating quality: Appearance | Zinc coating quality: Adherence | Zinc coating quality: Overall |
|---|---|---|---|---|---|---|---|---|
| 1 | 0.2 | 450 | 3 | 0.12 | | B | B | B |
| 2 | 0.3 | 450 | 3 | 0.20 | | A | A | A |
| 3 | 0.5 | 450 | 3 | 0.22 | | A | A | A |
| 4 | 0.8 | 450 | 3 | 0.25 | | A | A | A |
| 5 | 1.2 | 450 | 3 | 0.32 | | A | A | A |
| 6 | 2.0 | 450 | 3 | 0.40 | | A | B | B |
| 7 | 0.5 | 420 | 3 | 0.20 | | B | B | B |
| 8 | 0.5 | 430 | 3 | 0.25 | | A | A | A |
| 9 | 0.5 | 460 | 3 | 0.25 | | A | A | A |
| 10 | 0.5 | 470 | 3 | 0.23 | | A | A | A |
| 11 | 0.5 | 480 | 3 | 0.28 | | B | B | B |
| 12 | 0.5 | 500 | 3 | 0.38 | | B | B | B |
| 13 | 0.5 | 450 | 1 | 0.22 | | A | A | A |
| 14 | 0.5 | 450 | 1.5 | 0.15 | | A | A | A |
| 15 | 0.5 | 450 | 2 | 0.25 | | A | A | A |
| 16 | 0.5 | 450 | 5 | 0.27 | | A | A | A |
| 17 | 0.5 | 450 | 8 | 0.28 | | A | B | B |
| 18 | 0.5 | 450 | 10 | 0.35 | | A | B | B |
| 19 | 0.5 | 450 | 12 | 0.38 | | A | B | B |
| 20 | 0.5 | 450 | 15 | 0.39 | | B | B | B |
| 21* | 0* | 450 | 3 | 0.25 | | D | D | D |
| 22* | 0.1* | 450 | 3 | 0.22 | | C | C | C |
| 23* | 2.1* | 450 | 3 | 0.25 | | B | C | C |
| 24* | 0.5 | 200* | 3 | 0.22 | | D | D | D |
| 25* | 0.5 | 550* | 3 | 0.22 | | C | D | D |
| 26* | 0.5 | 450 | 16* | 0.25 | | C | C | C |
| 27* | 0.5 | 450 | 3 | 0.08* | | C | C | C |
| 28* | 0.5 | 450 | 3 | 1.1* | | C | A | C |
| 29 | 0.5 | 450 | 3 | 0.22 | Ni: 0.03 | A | A | A |
| 30 | 0.5 | 450 | 3 | 0.22 | Sb: 0.15 | A | A | A |
| 31 | 0.5 | 450 | 3 | 0.23 | Pb: 0.15 | A | A | A |

TABLE 1-2

| Sample No. | Amount of precoated nickel g/m² | Heating Conditions: Sheet-heating temperature °C. | Heating Conditions: Temperature elevation rate °C./s | Galvanization bath composition: Almunium % by weight | Galvanization bath composition: Additional alloy element % by weight | Properties: Coating appearance | Properties: B.I. Coating adherence at cup formation | Properties: Coating adherence at cup formation | Properties: Corrosion resistance at worked portion |
|---|---|---|---|---|---|---|---|---|---|
| 32 | 0.5 | 450 | 10 | 0.23 | | A | B | 2 | 2 |
| 33 | 0.5 | 450 | 20 | 0.25 | | A | A | 2 | 3 |
| 34 | 0.5 | 450 | 30 | 0.21 | | A | A | 3 | 4 |
| 35 | 0.5 | 450 | 40 | 0.22 | | A | A | 4 | 4 |
| 36 | 0.5 | 450 | 50 | 0.25 | | A | A | 5 | 5 |
| 37 | 0.5 | 450 | 70 | 0.26 | | A | A | 5 | 5 |
| 38 | 0.5 | 450 | 90 | 0.25 | | A | A | 5 | 5 |
| 39 | 0.5 | 430 | 70 | 0.25 | | A | A | 3 | 4 |
| 40 | 0.5 | 470 | 70 | 0.15 | | A | A | 5 | 5 |
| 41 | 0.5 | 480 | 70 | 0.32 | | A | A | 5 | 5 |
| 42 | 0.5 | 500 | 70 | 0.35 | | A | A | 3 | 3 |

What is claimed is:

1. A continuous hot-dip galvanization installation for galvanization of a nickel pre-coated steel sheet comprising a nickel electroplating apparatus, a non-oxidative atmosphere-heating apparatus, and a galvanizing apparatus having an outlet side and being equipped with a molten zinc adhering amount-controlling device at the outlet side, arranged sequentially in a delivery direction for the steel sheet, said non-oxidative atmosphere-heating apparatus comprising (i) a ring transformer having an inlet side and a space for steel sheet delivery, (ii) a conductor roll provided at the inlet side of the ring transformer and being connected by use of an electroconductive member to a molten zinc bath of the galvanizing apparatus, thus a secondary coil of the transformer being formed from the conductor roll, the electroconductive member and the delivered steel sheet between a point at which the steel sheet enters the molten zinc bath and a point at which the conductor roll contacts the steel sheet, where resistance $R_1$ of the steel sheet and resistance $R_2$ of the electroconductive member is in the relation of $R_1 > R_2$, (iii) an atmospheric chamber enclosing the steel sheet within the range from a point between the inlet side of the ring transformer and the conductor roll to a point just below a surface of the molten zinc bath, and (iv) an atmospheric gas-feeding device for feeding a non-oxidative gas to the atmospheric chamber.

* * * * *